United States Patent [19]

Toyoshima et al.

[11] Patent Number: 5,074,077

[45] Date of Patent: Dec. 24, 1991

[54] WINDOW REGULATOR

[75] Inventors: Takeshi Toyoshima; Takashi Suzuki, both of Shimizu, Japan

[73] Assignee: Koito Manufacturing Co., Ltd., Tokyo, Japan

[21] Appl. No.: 518,582

[22] Filed: May 2, 1990

[30] Foreign Application Priority Data

Jan. 8, 1990 [JP] Japan ..... 2-1286

[51] Int. Cl.[5] ..... E05F 11/48

[52] U.S. Cl. ..... 49/352; 474/117

[58] Field of Search ..... 49/352, 349, 348, 502, 49/360; 474/117, 138, 135

[56] References Cited

U.S. PATENT DOCUMENTS

| | | | |
|---|---|---|---|
| 1,827,746 | 10/1931 | Hansen | 49/352 |
| 2,987,937 | 6/1961 | Sala . | |
| 3,444,649 | 5/1969 | Rivolier | 49/352 |
| 4,171,594 | 10/1979 | Colanzi | 49/349 |
| 4,199,899 | 4/1980 | Mühling et al. | 49/352 |
| 4,403,450 | 9/1983 | Ishii . | |
| 4,440,354 | 4/1984 | Kobayashi et al. | 49/352 X |
| 4,442,632 | 4/1984 | Greco et al. | 49/352 |
| 4,468,887 | 9/1984 | Koch . | |
| 4,589,227 | 5/1986 | Bickerstaff . | |
| 4,631,864 | 12/1986 | Barros . | |
| 4,637,166 | 1/1987 | Ujihara | 49/374 X |
| 4,656,780 | 4/1987 | Miyauchi et al. . | |
| 4,660,325 | 4/1987 | Bauer et al. | 49/352 |
| 4,669,222 | 6/1987 | Ujihara et al. | 49/374 |
| 4,691,475 | 9/1987 | Maekawa | 49/352 |
| 4,727,681 | 3/1988 | Kinoshita et al. | 49/352 |
| 4,805,346 | 2/1989 | Gergoe | 49/352 |
| 4,819,377 | 4/1989 | Bauer et al. | 49/375 X |
| 4,823,512 | 4/1989 | Maekawa et al. | 49/352 |
| 4,878,391 | 11/1989 | Komatsu et al. . | |
| 4,941,286 | 7/1990 | Marscholl et al. | 49/352 |

FOREIGN PATENT DOCUMENTS

| | | | |
|---|---|---|---|
| 3638059 | 5/1987 | Fed. Rep. of Germany . | |
| 2382351 | 11/1988 | France . | |
| 8192 | of 1909 | United Kingdom | 474/135 |
| 831390 | 2/1957 | United Kingdom | 474/138 |

*Primary Examiner*—Gary L. Smith
*Assistant Examiner*—Jerry Redman
*Attorney, Agent, or Firm*—Sughrue, Mion, Zinn, Macpeak & Seas

[57] ABSTRACT

A window regulator comprising a vertically extending support member having respectively on upper and lower ends thereof turn up guide members, a drive cable extending between the two turn up guide members and being connected to a movable driven member such as a bracket connected to a window glass, and a drive mechanism for moving the drive cable. One of the turn up guide members is movably supported on the support member such that the distance between the turn up guide members can be changed, and a spring is provided to urge the movable turn up guide member in the direction separating from the stationary turn up guide member.

6 Claims, 6 Drawing Sheets

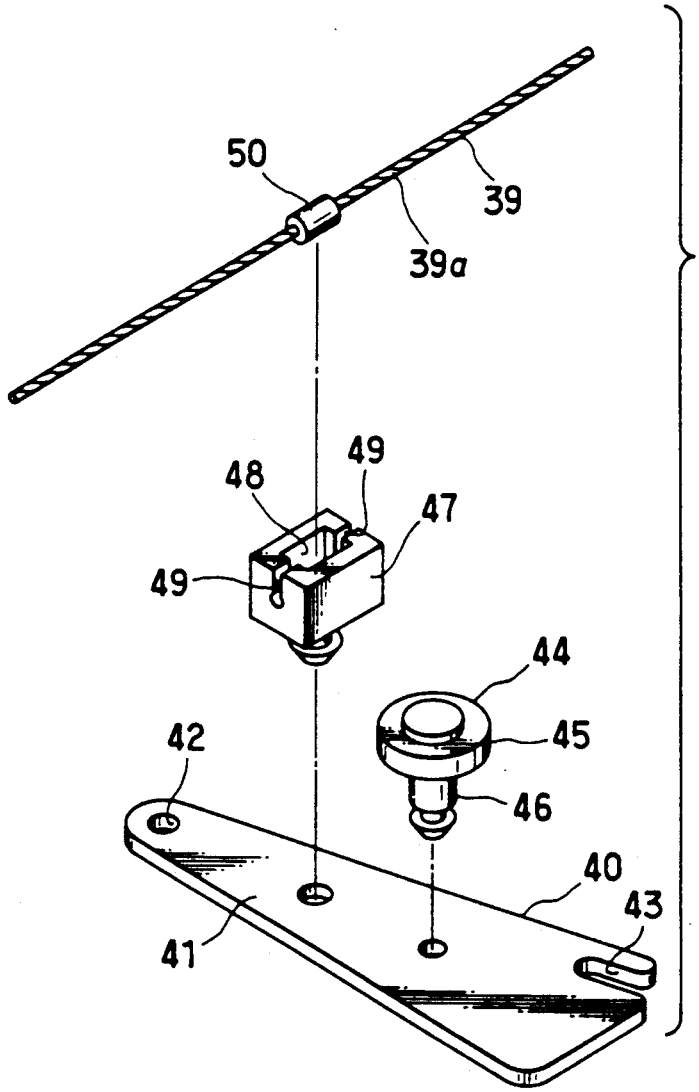
FIG. 7
FIG. 8
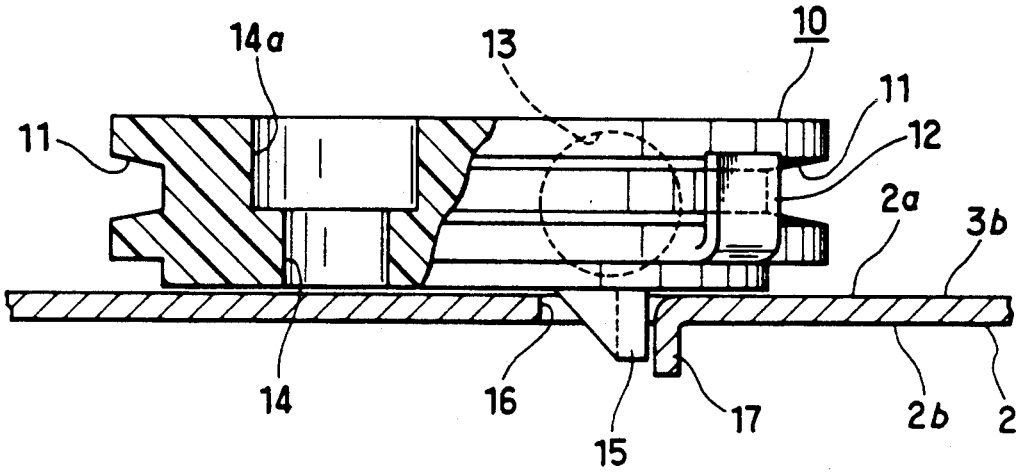

WINDOW REGULATOR

FIELD OF THE INVENTION

The present invention relates to a window regulator and, particularly to a window regulator adapted to move up and down a window glass of an automobile or the like.

DESCRIPTION OF PRIOR ART

Various proposals have been made with respect to the window regulator of above described type, and one of them is called as cable type including a drive cable connecting a drive motor with a driven member.

The drive cable consists of a plurality of twisted fine steel wires, and is lengthened during usage. When the cable is lengthened, the cable tends to escape from a pulley, a winding up drum or the like, and smooth movement of the member being elevated cannot be obtained and noise is produced.

An object of the invention is to provide a novel window regulator of the cable type which overcomes above described shortcomings.

SUMMARY OF THE INVENTION

According to the invention, there is provided a window regulator comprising a vertically extending support member having respectively on upper and lower ends turn up guide members, a drive cable extending between the two turn up guide members and being connected to a movable driven member, and a drive mechanism for moving the drive cable; at least one of the turn up guide members being movably supported on the support member such that the distance between the turn up guide members can be changed, and a bias mechanism being provided to bias the one guide member in the direction separating from the other of the turn up guide members.

According to the invention, when the drive cable is lengthened due to the long period of usage, the movable guide member is moved in the direction separating from the other of the turn up guide members by the biassing force of the bias mechanism and the slack of the drive cable is taken up. Thus, a suitable tension is maintained on the drive cable permanently and a reliable operation of the window regulator is assured.

BRIEF DESCRIPTION OF THE DRAWINGS

Further objects and effects of the invention will become apparent from the following detailed description in conjunction with the drawings, in which:

FIG. 7 is an exploded perspective view showing a connecting portion between a drive cable and a supporting member, and FIG. 8 is a partially broken bottom view of a cable guide.

DETAILED DESCRIPTION OF PREFERRED EMBODIMENTS

Figure 1:
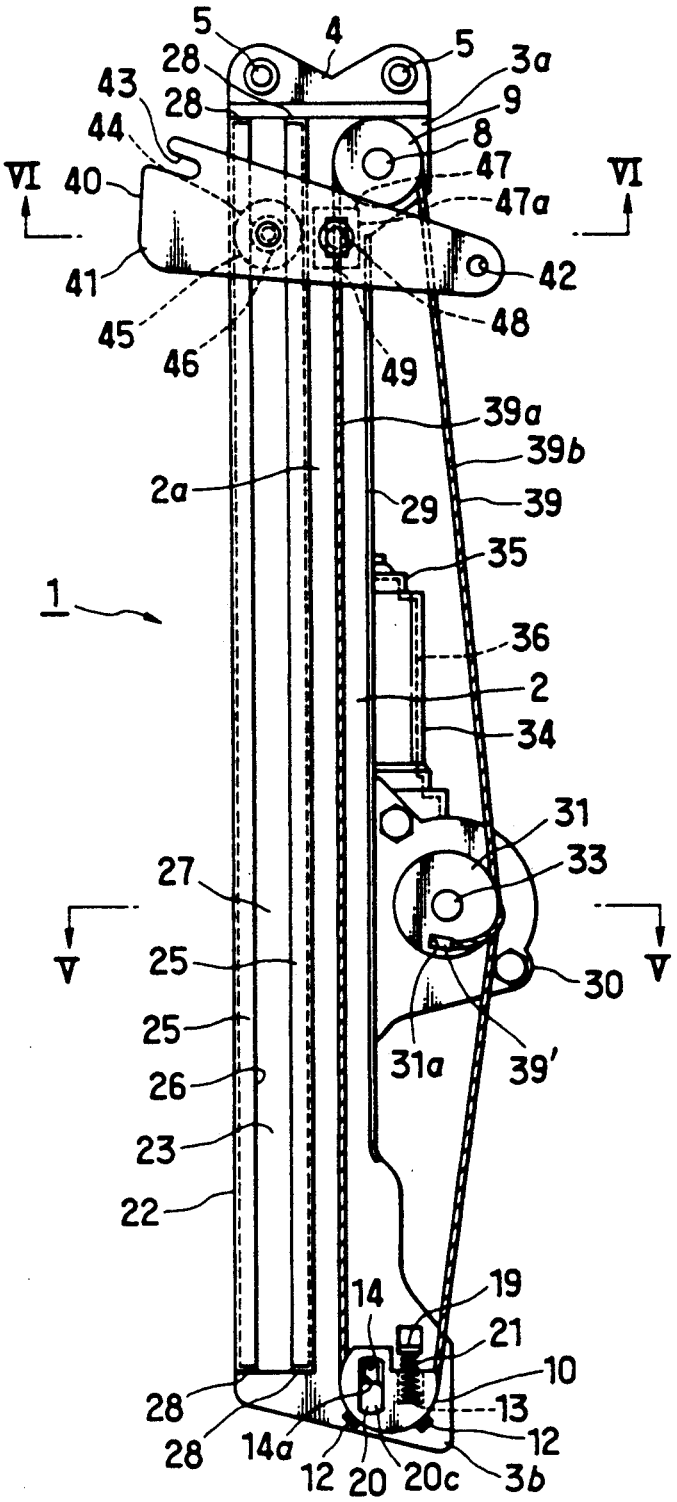
FIG. 1 is a front view of a window regulator according to a preferred embodiment of the present invention.

Shown in the drawings is a window regulator 1 as one embodiment of the present invention as applied for moving up and down a window glass of an automobile.

Supporting Plate

Shown at numeral 2 is a support plate formed of a sheet metal into an elongated form. The plate 2 is curved gently with vertically central portion of one surface 2*a* projecting and vertically central portion of the other surface 2*b* being recessed.

There are provided projections 3*a* and 3*b* respectively on one side edges of upper and lower ends of the support plate 2, whereby the upper and lower ends of the support plate 2 have wide width as compared with remaining portions.

Figure 2:
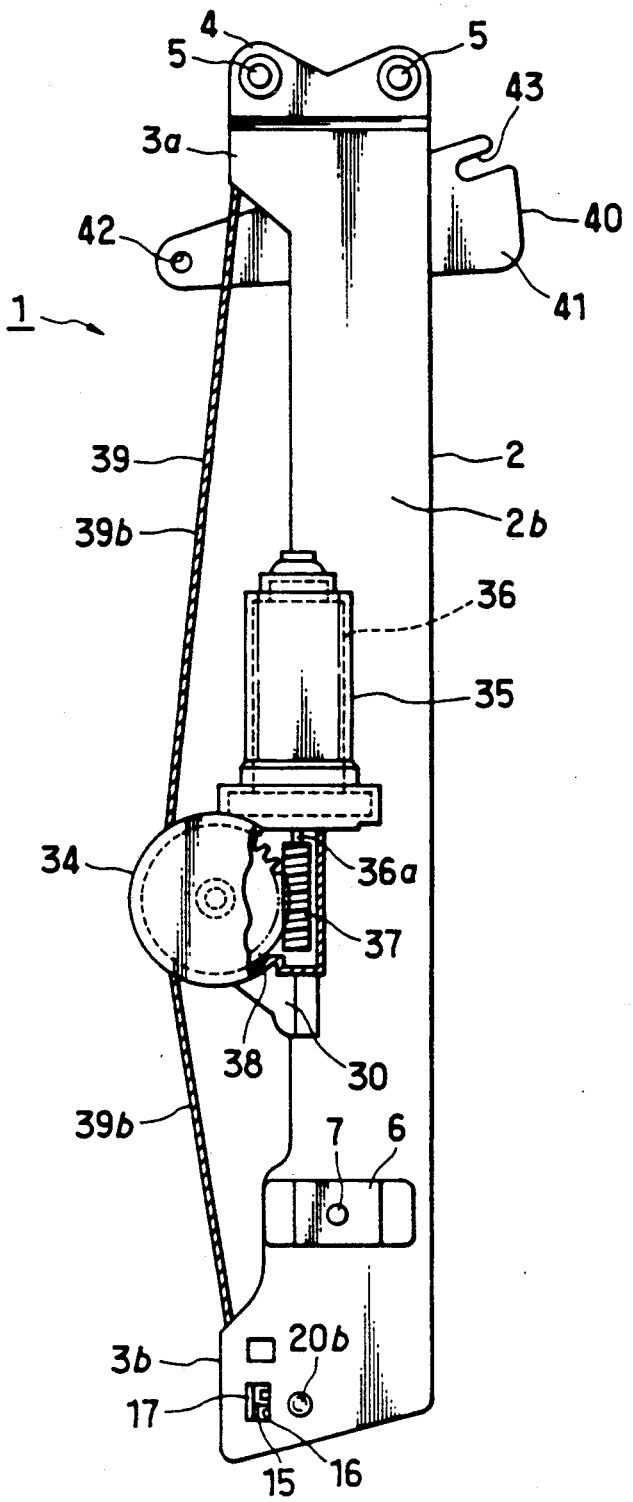
FIG. 2 is a partially broken rear view of the window regulator of FIG. 1.
Figure 3:
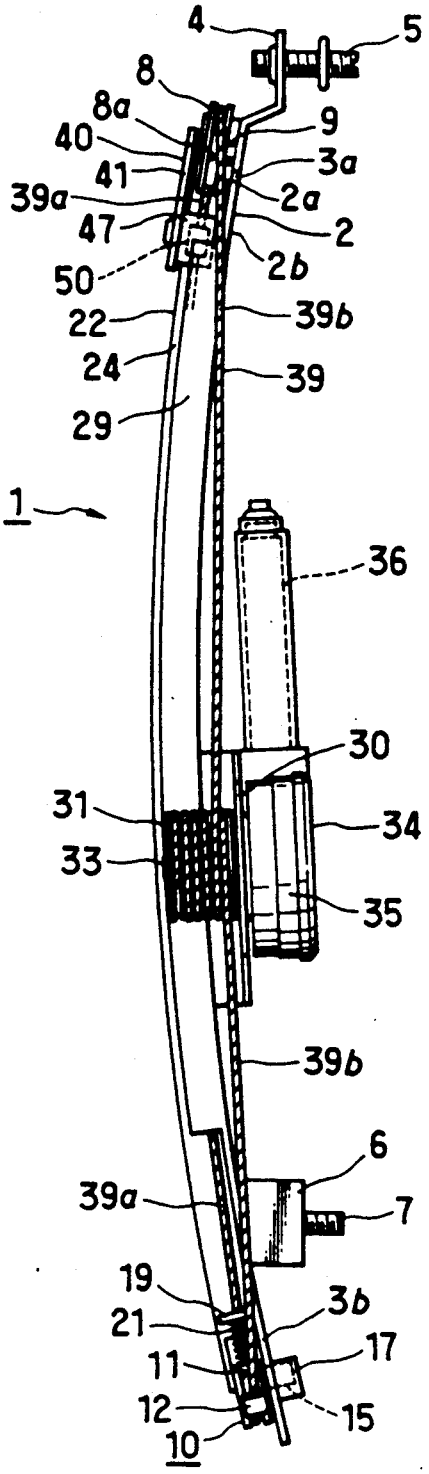
FIG. 3 is a side view of the window regulator of FIG. 1.

Shown at numeral 4 is a mounting piece projecting from the upper end of the support plate 2 to have a generally L-shape in the side view and projecting toward the other surface 2*b*. There are provided mounting bolts 5 on the mounting piece 4 as shown in FIGS. 1 and 3. As shown in FIGS. 2 and 3, a mounting boss 6 having thereon a mounting bolt 7 is secured on the other surface 2*b* and near to the lower end of the support plate 2. These mounting bolts 5 and 7 act to mount the support plate 2 on or in such as a door structure of an automobile.

Turn Up Guide Member

Shown at numeral 8 (FIGS. 1 and 3) is an idler pulley mounted rotatably around a support shaft 9 which is secured to and projecting from the one surface 2*a* and adjacent to the projection 3*a*. A circumferential groove 8*a* is formed in the outer periphery of the idler pulley 8 for receiving and guiding a drive cable 39 explained hereinafter. The idler pulley 8 constitutes upper stationary turn up member.

Figure 4:
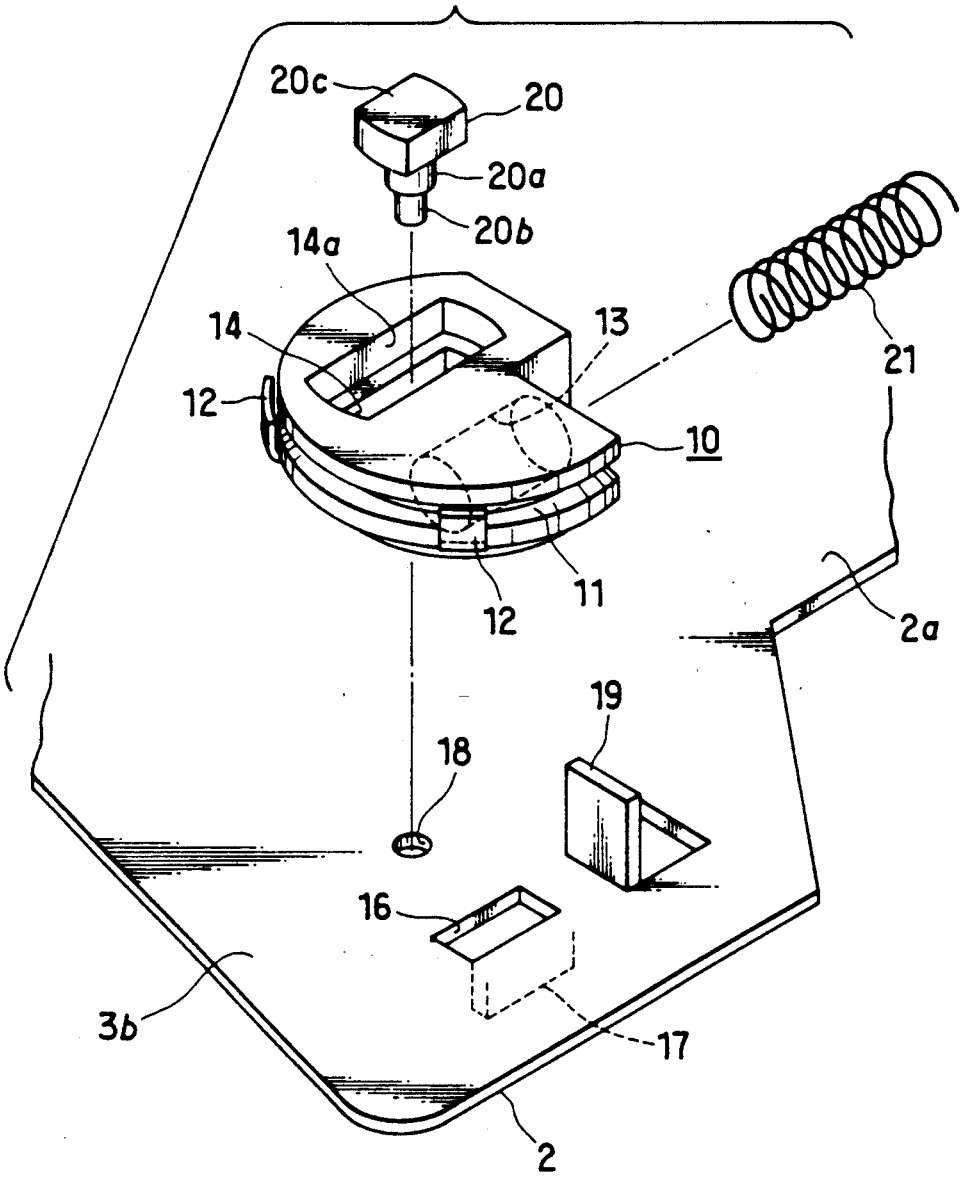
FIG. 4 is an exploded perspective view of the essential portion of the embodiment of FIG. 1.

Cable guide 10 having a generally semi-circular form as viewed in the front view (FIG. 1) is vertically movably mounted on the lower projecting portion 3*b* of the support plate 2. An groove 11 is formed in the arcuated outer circumference of the cable guide 10 for receiving and guiding the drive cable 39. Projecting pieces 12 are formed on one side surface of the cable guide 10 to project toward the other side surface of the cable guide 10 and above the groove 11 at spaced relationship as shown in FIGS. 1 and 4. The projecting pieces 12 act to prevent the drive cable 39 from escaping out of the groove 11. The cable guide 10 constitutes the lower turn up member according to the invention.

The outer periphery of the cable guide 10 not having the groove 11 or the upper surface of the cable guide 10 has a generally stepped form as shown in FIG. 1. A bore 13 is formed in the upper surface of the cable guide 10 to extend downward. A guide opening 14 of vertically elongated form and having a counterbored portion 14*a* is formed in the cable guide 10 to extend therethrough in the direction of the thickness. A projection 15 is formed on the rear side surface of the cable guide 10.

An vertically elongated guide opening 16 is formed in the lower end portion of the support plate 2, and along one vertically extending side edge of the guide opening 16 there is formed a guide wall or flange 17 by cutting and bending rearward. A mounting hole 18 is formed in the support plate 2 at the location spaced from the guide opening 16 as shown in FIG. 2. An abutting wall 19 is formed on the support plate 2 adjacent to and upward of the guide opening 16 by cutting and bending as shown in FIG. 4.

A guide pin 20 comprises a cylindrical intermediate portion 20*a*, a caulking portion 20*b* projecting from the rear end of the intermediate portion 20*a* with the diameter being smaller than that of the intermediate portion 20*a*, and a generally rectangular head portion 20*c* formed on the front end of the intermediate portion 20*a*. The head portion 20*c* of the guide pin 20 is adapted to be snugly and slidably received in the counterbored portion 14*a* of the guide opening 14 in the cable guide 10. The intermediate portion 20*a* of the guide pin 20 is adapted to be snugly and slidably received in the guide opening 14. The caulking portion 20*b* is inserted through the mounting hole 18 in the support plate 2 and is secured by caulking. Thus, the cable guide 10 is supported on the lower end portion of the support plate 2 and is movable in the vertical directions.

Biassing Mechanism

Shown at numeral 21 is a coil spring for biassing the cable guide 10 downward or in the direction separating from the idler pulley 8. One end of the spring 21 is received in the bore 13 in the cable guide 10 and the other or the upper end of the spring 21 abuts with the abutting wall 19 of the support plate 2.

Guide Rail

Shown at 22 (FIGS. 1, 3, 5 and 6) is a guide rail being formed of a sheet metal. The guide rail 22 includes a base portion 23, two side portions 24 and 24 projecting from opposite side edges of the base portion 23 in the same direction, engaging portions 25 and 25 extending respectively in opposing direction from the projecting edges of the side portions 24 and 24. A vertical slit 26 is defined between the engaging portions 25 and 25. The guide rail 22 defines a vertically extending generally rectangular guide space 27. On the upper and lower ends of the side portions 24 and 24 there are integrally formed stop pieces 28 to project into the guide space 27. The base portion 23 of the guide rail 22 is gently curved along the surface 2*a* of the support plate 2 and, thus, the guide space 27 is also curved.

The guide rail 22 is secured to the support plate 2 with the base portion 23 being secured to the surface 2*a* of the support plate 2 along one side edge thereof by such as spot welding process.

Shown at numeral 29 is a guide wall formed along the other side edge of the support plate 2 to project from the surface 2*a* and at intermediate portion between the projections 3*a* and 3*b*. The guide wall 29 is parallel to adjacent side portion 24 of the guide rail 22 and is spaced therefrom by a predetermined distance.

Drive Reel, Driving Mechanism

Figure 5:
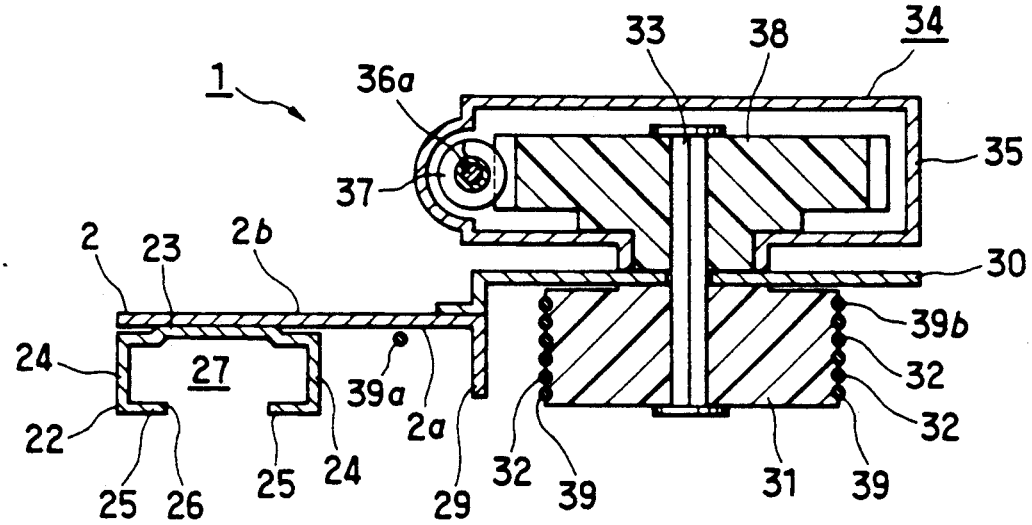
FIG. 5 is an enlarged sectional view taken generally along line V—V of FIG. 1.
Figure 6:
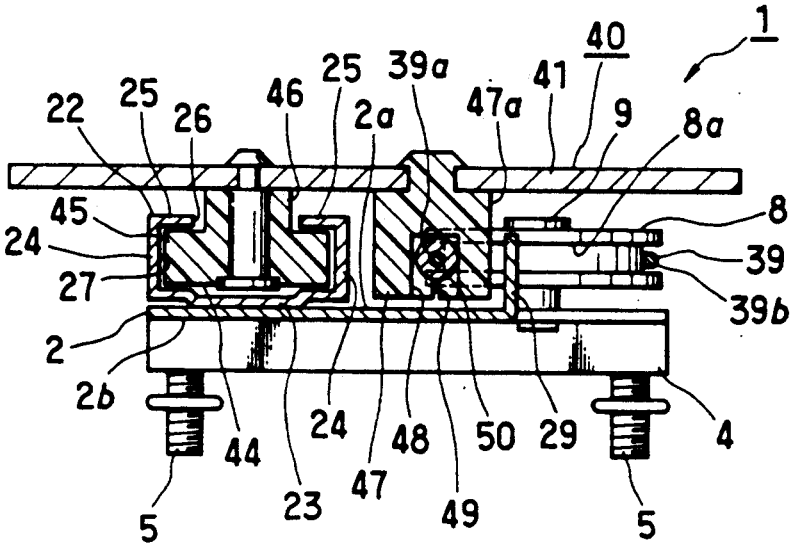
FIG. 6 is an enlarged sectional view taken generally along line VI—VI of FIG. 1.

Shown at numeral 30 is a mounting member secured to the surface 2*b* of the support plate 2 at the location slightly downward from the vertical central portion to project from the other side edge of the support plate 2 as shown in FIGS. 1 and 5.

A drive reel 31 is rotatably supported on one surface of the mounting member 30 and has in the outer circumference a helical groove 32. One end of a shaft 33 is secured to the central portion of the drive reel 31, and the other end passes through the mounting member 30 and is secured to the central portion of a worm wheel 38 of a drive mechanism 34 described hereinafter.

The drive mechanism 34 comprises a casing 35 secured to the mounting member 30, a DC motor 36, a worm gear 37 secured to a rotatable shaft 36*a* of the motor 36, and the worm wheel 38 meshingly engaging with the worm gear 37. Thus, when the motor 36 is rotated, the rotation is transmitted through the worm gear 37, the worm wheel 38 and the shaft 33 to the drive reel 31.

Drive Cable

The drive cable 39 extends between and around the idler pulley 4 and the cable guide 10 which are supported on upper and lower ends of the support plate 2 respectively. The opposite end portions of the drive cable 39 are wound along the helical groove 32 with the opposite ends 39' (only one is shown in FIG. 1) being retained in recesses 31*a* (only one is shown in FIG. 1) which, in turn, are formed in respective side surfaces of the drive reel 31.

Bracket

Shown at numeral 40 is a bracket for supporting a driven member or a member being elevated/descended such as a window glass or an automobile. A main portion 41 of the bracket 40 is formed of a metal plate and has in one end portion a mounting opening 42 and in another end portion a cutout 43 as shown in FIG. 1.

A guide block 44 having a circular disc-like portion 45 adapted to be received in the guide space 27 and a cylindrical base portion 46 integrally formed with the portion 45 and being adapted to pass through the slit 26 in the guide rail 22 is secured to the main portion 41 of the bracket 40 as shown in FIG. 7. Thus, the bracket 40 is supported on the supporting plate 2 movably along the guide space 27 of the guide rail 22.

A connecting block 47 of a generally rectangular block-like shape is also secured to the bracket 40 as shown in FIG. 7. One side surface 47*a* of the block 47 is parallel to and spaced by a small distance from the guide wall 29 of the support plate 2.

Shown at 48 is a receiving recess formed in generally central portion of the connecting block 47, and at 49 are grooves formed in the connecting block 47 to extend vertically and communicating with the recess 48.

A fitting block 50 is secured to a portion 39*a* of the drive cable 39, and is fitted in the receiving recess 48 in the connecting block 47. The portions of the drive cable 39 and upper and lower of the fitting block 50 are fitted in grooves 49 in the connecting block 47 respectively.

Operation

The driven member such as a window glass is supported by a screw (not shown) mounted on the mounting opening 42 and a screw (not shown) mounted on a cutout 43 in the main portion 41 of the bracket 40.

When the DC motor 36 is rotated, the portion 39*a* of the drive cable 39 moves upward or downward according to the direction of the rotation of the motor 36, thus, the bracket 40 connected thereto moves upward or downward along the guide space 27 in the guide rail 22.

When the drive cable 39 is elongaged or lengthened during the usage, the cable guide 10 moves downward by the spring force of the spring 21 thereby taking up any slack in the drive cable 39. The drive cable 39 is maintained to have a predetermined tension which assures reliable operation of the window regulator.

Preferably, the length of the drive cable 39 is, in the initial condition, adjusted with the cable guide 10 being located at or near to the uppermost position.

Advantages of the Invention

As described heretofore, the window regulator according to the present invention comprises a vertically extending support member having respectively on upper and lower ends thereof turn up guide members, a drive cable extending between the two turn up guide members and being connected to a movable driven member, and a drive mechanism for moving the drive cable; at least one of the turn up guide members being movably supported on the supported member such that the distance between the turn up guide members can be changed, and a bias mechanism being provided to bias the one turn up guide member in the direction separating from the other of the turn up guide members.

Thus, when the drive cable 39 is elongated during the usage, the one turn up guide member or a cable guide moves in the direction separating from the other turn up guide member or a idler pulley by the spring force of the spring thereby taking up any slack in the drive cable. Thus, the drive cable is maintained to have a predetermined tension which assures reliable operation of the window regulator.

It will be understood that the embodical construction described as above is a mere example of a preferred embodiment of the invention and that various changes or modifications can easily be made for those skilled in the art. For example, the idler pulley 8 may be mounted adjustably on the support plate 2 so as to approach or separate from the cable guide 10, which is convenient in adjusting the initial tension of the drive cable 39. It is intended that the present invention is defined by the appended claims which cover all such changes or modifications which fall within the true spirit and scope of the invention.

We claim:

1. A window regulator comprising a vertically extending support member having respectively on upper and lower ends thereof turn up guide members, a drive cable extending between the two turn up guide members and being connected to a movable driven member, and a drive mechanism for moving the drive, at least one of the turn up guide members being movably supported on the support member such that the distance between turn up guide members can be changed, said at least one turn up guide member comprising a cable guide having a generally semi-circular form with an arcuate groove formed in an outer periphery thereof to slidably receive said drive cable, said cable guide further comprising a pair of projecting pieces formed along one side surface thereof and projecting toward an opposed side surface thereof, and said cable guide having an elongated guide opening extending vertically therethrough and a bore formed therein extending parallel to said guide opening, said outer periphery outside said groove being stepped, a guide pin fixed to said support member and slidably received in said guide opening, and a bias mechanism being provided to bias the one guide member in the direction separating from the other of the turn up guide members, said bias mechanism comprising a compression spring having one end portion thereof received in said bore.

2. A window regulator according to claim 1, wherein the other of the turn up guide members is an idler pulley being rotatably mounted on the support member.

3. A window regulator according to claim 1, wherein the drive cable extends between the two turn up guide members with the opposite ends of the drive cable being connected to the drive mechanism.

4. A window regulator according to claim 3, wherein the drive mechanism includes a reversible motor and a drive reel driven by the motor and having a helical groove in the outer circumference for receiving the drive cable, the opposite ends of the drive cable being retained on the drive reel.

5. A window regulator according to claim 1, wherein a driven member being moved up and down by the window regulator comprises a bracket vertically movably supported on the support member and a member such as a window glass of an automobile and connected to the bracket.

6. A window regulator according to claim 5, wherein the bracket comprises a roller retained in a guide rail formed on the support member and a connecting piece connected to the drive cable.

* * * * *